United States Patent [19]

Lancz

[11] Patent Number: 4,784,788

[45] Date of Patent: Nov. 15, 1988

[54] CLEANING PASTE WITH SOLUBLE ABRASIVE

[75] Inventor: Albert J. Lancz, East Brunswick, N.J.

[73] Assignee: Colgate-Palmolive Co., New York, N.Y.

[21] Appl. No.: 132,527

[22] Filed: Dec. 14, 1985

[51] Int. Cl.[4] ..... C11D 3/04; C11D 3/075; C11D 3/43; C11D 17/08

[52] U.S. Cl. ..... 252/114; 252/108; 252/109; 252/122; 252/139; 252/158; 252/163; 252/164; 252/170; 252/174.14; 252/174.21; 252/174.22; 252/DIG. 5; 252/DIG. 10; 252/DIG. 14

[58] Field of Search ..... 252/108, 109, 114, 122, 252/139, 158, 163, 164, 170, 174.14, 174.21, 174.22, DIG. 5, DIG. 10, DIG. 14, 1

[56] References Cited

U.S. PATENT DOCUMENTS

| | | | |
|---|---|---|---|
| 2,864,770 | 12/1958 | McCune | 252/138 |
| 3,522,186 | 7/1970 | Cambre | 252/112 |
| 3,577,347 | 5/1971 | Monick | 252/99 |
| 3,664,962 | 5/1972 | Kelley | 252/125 |
| 3,850,833 | 11/1974 | Koceich et al. | 252/99 |
| 3,865,756 | 2/1975 | Smith | 252/529 |
| 3,981,826 | 9/1976 | Munro | 252/526 |
| 4,048,123 | 9/1977 | Hramchenko | 252/545 |
| 4,051,055 | 9/1977 | Trinh et al. | 252/95 |
| 4,107,067 | 8/1978 | Murphy et al. | 252/135 |
| 4,155,871 | 5/1979 | Donaldson | 252/156 |
| 4,179,414 | 12/1979 | Clayton | 252/548 |
| 4,257,908 | 3/1981 | Wixon | 252/135 |
| 4,289,640 | 9/1981 | Falivene | 252/95 |
| 4,657,692 | 4/1987 | Choy et al. | 252/99 |
| 4,673,526 | 6/1987 | Zabotto | 252/174.16 |
| 4,734,222 | 3/1988 | Winterton | 252/546 |

FOREIGN PATENT DOCUMENTS 0193375 9/1986 European Pat. Off. .

*Primary Examiner*—Dennis Albrecht

*Attorney, Agent, or Firm*—Richard J. Ancel; Murray M. Grill

[57] ABSTRACT

A hard surface highly viscous cleaning composition comprising by weight about 65–80% of an organic liquid vehicle consisting essentially of about 15–35% water miscible organic solvents and about 35–70% of a nonionic surfactant mixture containing an ethoxylated fatty acid as one of the surfactants, and sodium hydroxide which reacts in situ with the ethoxylated fatty acid to form a clear organic, nonflowable gelled vehicle, substantially free of water. Another feature of this invention is the stable suspension of about 10–25% of a water soluble particulate builder-abrasive in said nonflowable organic gel which is in the form of a viscous cleaning gel product.

14 Claims, No Drawings

CLEANING PASTE WITH SOLUBLE ABRASIVE

BACKGROUND AND PRIOR ART

The present invention relates to the formulation of a stable, hard surface detergent composition in the form of a non-pourable viscous cleaning composition, substantially free of water, i.e., having a maximum water content of 6% by weight, comprising a gelled mixture of an organic liquid vehicle consisting essentially of organic solvents and nonionic surfactants including an ethoxylated fatty acid as the essential component in the in situ gelation of said liquid vehicle, upon the addition of a small amount of about 0.7–1.5% by weight sodium hydroxide. The addition of gel-insoluble ingredients, particularly a water-soluble inorganic builder-abrasive, to the gel mixture forms a viscous paste product containing a stable suspension of the relatively large particles of said abrasive.

The abrasive is insoluble in the gel product, but soluble in water. Thus, after using this paste product to clean a hard surface, the water applied to rinse off the cleaning product dissolves both the gel and the abrasives, and leaves no gritty residue on or around the cleaned surfaces.

The prior art is replete with hard surface cleansers containing abrasives both in the form of scouring powders and in liquid form. Water insoluble abrasives as the major and primary cleaning component in scouring powder cleansers is well known, as disclosed in U.S. Pat. No. 3,850,833. However, the use of said water-insoluble abrasives in hard surface scouring powder cleansers has been found to leave an unpleasant gritty residue on the cleaned surface. This problem has been addressed in the prior art by substituting a water soluble abrasive for all or part of the insoluble abrasive, resulting in a composition wherein the water soluble components rinse away with the wash water, leaving substantially no residue on the cleaned surface, as disclosed in U.S. Pat. No. 3,577,347. Another method of addressing the abrasive residue problem is the use of a powdered or particulate water-insoluble abrasive having a maximum particle size under 0.15 mm., and about 8% by weight of the abrasive particle having a diameter of about 0.037 mm or larger for effective cleaning, and a small amount of an organic hydrotrope (i.e., sodium cumene sulfonate) to improve grease removal, as disclosed in U.S. Pat. No. 4,289,640.

Likewise, hard surface liquid detergent composition containing water-insoluble abrasives suspended in an aqueous medium encounter the problems of stability as well as the difficulty of complete removal of the insoluble abrasive particles from the cleaned surface. These problems have been addressed in the prior art preparing a heavy duty liquid detergent composition containing a water soluble builder salt having colloidal-size particles (below 1 micron and usually below 0.1 micron), dispersed in an aqueous medium containing a fatty acid amide emulsifying agent as disclosed in U.S. Pat. No. 4,057,506. Other means of addressing the stability problem is disclosed in U.S. Pat. No. 3,522,186 wherein is disclosed a water-insoluble abrasive dispersed in an aqueous medium containing tetrapotassium pyrophosphate, sodium soap, diethanolamide and about 0.25–1.5% methanol or ethanol to prevent the separation of the aqueous liquid into two layers. Another means of addressing the stability problem is disclosed in U.S. Pat. No. 4,051,055 wherein an aqueous hard surface cleaning composition containing water insoluble abrasive is suspended in a thickened aqueous medium with at least 1% clay as the thickening agent, said thickened system preventing separation of the abrasive from the liquid medium. The presence of fluoride salts enhances the ability of the clay-thickened system to hold the abrasive particles in suspension.

U.S. Pat. No. 4,657,692 also discloses a thickened aqueous scouring cleanser, free of syneresis (separation of solids from liquid), containing a water insoluble abrasive suspended in an aqueous medium containing a colloidal aluminum oxide thickener, water soluble alkali metal inorganic salts such as the phosphates, polyphosphates, carbonates, etc., and about 0.5–3% of a surfactant and a halogen bleach. European Patent Application No. 0.193,375 resorts to the use of a water soluble salt, which functions both as an abrasive and detergency builder, such as sodium bicarbonate, tripolyphosphate, and the like, in a pourable, homogenous abrasive-containing aqueous detergent composition for cleaning hard surfaces, and also containing a mixture of anionic and nonionic surfactants in the weight ratio of 1:1 to 9:1 anionic to nonionic surfactant.

A hard surface, water-based cleanser in paste form comprising 50–65% sodium bicarbonate and 50–35% by weight water containing sodium chloride and a fatty acid ($C_{12}$–$C_{16}$) diethanolamide is disclosed in U.S. Pat. No. 4,179,414.

Water-based gels containing at least 40% nonionic surfactant and 2-10% water soluble builder salts is disclosed in U.S. Pat. No. 4,107,067 as a flowable gel laundry detergent composition.

U.S. Pat. No. 4,257,908 also discloses a laundry detergent composition in a stable flowable form, containing 25–55% of a phosphate builder salt, 5–40% of an anionic surfactant in 30–50% of an aqueous medium containing alcohol in the weight ratio of 5:1 to 20:1 water to alcohol.

Also, non-aqueous liquid pasty or gelatinous detergent compositions having scouring properties is disclosed in U.S. Pat. No. 3,981,826, comprising a dispersion of a normally solid water soluble anionic surfactant and a solid particulate water soluble inorganic salt (a builder salt) and a suspending agent such as highly-voluminous oxides (silica, magnesia, alumina or clay) in about 19–79% of a water-miscible organic liquid solvent such as a polyhyrdic alcohol (glycerol, ethylene glycol, and the like), and optionally a lower monohydric alcohol (ethanol, methanol, etc.). Another organic solvent-based gelled or thickened hard surface cleaning composition which is flowable and pourable is disclosed in U.S. Pat. No. 3,865,756 comprising a gelling agent which functions as an abrasive such as colloidal silica, an alkaline builder salt such as water soluble phosphates and silicantes, a surfactant, a water insoluble abrasive, i.e., calcium silicate, and about 55–90% of an organic cleaning solvent such as a major amount of an aliphatic hydrocarbon mineral spirit mixed with 4–7% ethylene glycol monobutyl ether. U.S. Pat. No. 2,864,770 also discloses a pourable non-aqueous water-soluble organic solvent-based thixotropic liquid detergent composition containing glycols and glycerol as the organic solvent, an anionic surfactant, and a phosphate builder in suspension.

However, none of the above mentioned patents disclose a hard surface non-pourable viscous cleaning composition, substantially free of water, comprising a gelled mixture of an organic liquid vehicle consisting essentially of water-soluble organic solvents and nonionic surfactants including an ethoxylated fatty acid as one of the surfactants, and a small amount of sodium hydroxide which reacts in situ with the ethoxylated fatty acid to form a clear organic, non-flowable gel, and about 10–25% of a water soluble builder-abrasive suspended in said gelled vehicle.

SUMMARY OF THE INVENTION

It has now been found that the formulation of present novel organic cleaning composition is based on the ability of ethoxylated fatty acid, i.e., ethoxylated lauric acid, a react with sodium hydroxide in organic media and form a gel with the media. Another feature of present novel formulation is the incorporation of a water-soluble abrasive material into the organic gelling mixture. This enables the preparation of viscous products containing inorganic solids suspended in a gelled organic vehicle. While this abrasive is insoluble in the gelled vehicle, it becomes soluble upon dilution of the product with water. Cleaning with the undiluted product is aided by the mild abrasive action of the abrasive, i.e., sodium pyrophosphate. The entire product dissolves in water leaving no gritty residue on or around the cleaned surfaces. Furthermore, this abrasive becomes a "surfactant builder" when the product is used diluted. Household surfaces such as ceramic and formica surfaces can be cleaned with present novel products in the absence or presence of water without scratching the surface. This product, both undiluted and diluted, has significantly improved cleaning efficiency provided by the triple action of the organic solvent, the nonionic detergent and the abrasive. In the diluted product, the abrasive dissolves in the water and becomes a detergency builder. The hard surface organic viscous product in accordance with this invention can function as a spray cleaner, a scouring cream and a floor and wall all purpose cleanser. Simulated floor cleaning tests show that at 3 g/l of present novel cleaning product performed better than "Mr. Clean" at 15 g/l. this translates to 5 bottles of Mr. Clean being equal to 1 bottle of present cleaning product.

Accordingly, the primary object of this invention is to provide a novel hard surface viscous organic cleaning product comprising an ethoxylated fatty acid and sodium hydroxide dissolved in an organic vehicle which react in situ to form a gelled vehicle.

Another object of this invention is to provide a novel viscous organic cleaning composition containing inorganic water-soluble particulate abrasive suspended in the gelled organic vehicle.

Still another object of this invention is to provide an abrasive-containing organic gel which dissolves in water leaving no gritty residue on or around the cleaned surfaces.

Still another object of this invention is to provide an all purpose organic cleanser having threefold cleansing action.

Additional objects, advantages and novel features of the invention will be set forth in part in the description which follows, and in part will become apparent upon examination of the following specification or may be learned by practice of this invention.

To achieve the foregoing and other objects in accordance with the present invention as embodied and broadly described herein, the novel, stable, hard surface non-pourable organic cleaning gel composition of this invention comprises about 65–80% of weight of an organic liquid vehicle consisting essentially of about 15–35% by weight of a water miscible organic solvent, about 35–70% of a nonionic surfactant mixture containing an ethoxylated fatty acid as one of the surfactants, and a small amount of about 0.7–1.5% by weight of sodium hydroxide, which reacts in situ with the ethoxylated fatty acid to form a clear, nonflowable gelled vehicle, substantially free of water, capable of suspending water-soluble inorganic particulate abrasive.

More specifically, the organic gel composition of present invention comprises about 65–80% by weight of a substantially water-free organic vehicle consisting essentially of about 15–35% by wight of a water soluble organic solvent and about 35–70% by weight of a nonionic surfactant mixture containing an ethoxylated fatty acid as one of the surfactants, about 0.7–1.5% by weight of sodium hydroxide, gelled by the in situ reaction of the ethoxylated fatty acid with the sodium hydroxide; and about 10–25% by weight of an inorganic water soluble particulate abrasive (builder salt) uniformly suspended in the gelled vehicle.

The water miscible organic solvent is selected from the group consisting of lower alkyl glycol ethers, lower alkyl monohydric alcohols, lower alkyl dihydric alcohols, and mixture thereof.

The described hard surface cleaning products of present invention are stable, non-pourable, clear, thick (viscous) pastes, having a minimum viscosity of about 14,000–15,000 cps units measured on Brookfield HATD viscometer. The viscosity of the gel product provides a stable suspension of relatively large particles of water-soluble abrasives, i.e., larger than colloidal sized particles. The product of present invention has many applications as an all purpose cleaner. Undiluted with water, the product can be used as a scouring cleaner for sinks and tubs, and as a spot cleaner for soiled hard surfaces, providing triple cleaning action due to the coaction of the organic solvent, the nonionic detergent and the abrasive, without leaving a gritty residue conventional with abrasive cleansers. Present novel organic pastes diluted with water can be used as a floor and wall cleaner. Present novel organic cleaning pastes can also be used as a waterless hand cleaner, particularly for mechanics and gardeners; for cleaning industrial and institutional cooking vessels, urns, etc.

DETAILED DESCRIPTION OF THE INVENTION

The major essential component of present nonpourable viscous cleaning composition is the nonionic surfactant system which constitutes about 35–70% by weight of a mixture of nonionic surfactants containing about 6–38% of an ethoxylated fatty acid, and about 10–64% of the other ethoxylated nonionic surfactants which may be a fatty alcohol, an alkyl phenol, a propylene oxide-propylene glycol condensation product, or a mixture thereof. More specifically, the additional ethoxylated nonionic surfactant may be selected from the group consisting of a polyethylene oxide condensate of an alkyl phenol having an alkyl group containing about 6 to 12 carbon atoms, a polyethylene oxide condensate of an aliphatic alcohol containing about 8 to 22 carbon atoms, a polyethylene oxide condensate of the condensation product of propylene oxide with propylene glycol having a molecular weight of about 1500 to 1800, and mixtures thereof. Typical examples of polyethylene oxide condensates of alkyl phenol are nonyl phenol condensed with about 9.5 moles ethylene oxide per mole nonyl phenol, dodecyl phenol condensed with about 12 moles of ethylene oxide per mole of phenol. Typical examples of ethoxylated alcohols include about 6 moles ethylene oxide condensed with one mole of tridecanol, myristyl alcohol condensed with about 10 moles ethylene oxide, $C_{10}$–$C_{14}$ fatty alcohol condensed with about 6 moles ethylene oxide, $C_{10}$–$C_{14}$ alcohol condensed with 5 moles ethylene oxide per mole alcohol (Alfonic 1012-60). Examples of the polyethylene oxide condensates of the condensation product of propylene oxide with propylene glycol are commercially available as Pluronic surfactants marketed by the Wyandotte Chemicals Corporation. The liquid character of this product is retained up to the point where the polyoxyethylene content is about 50% of the total weight of the condensation product. Examples of ethoxylated fatty acids include lauric, palmitic, stearic acid, etc., ethoxylated with about 5 to 10 ethylene oxides per mole fatty acid. A preferred fatty acid ethoxylate is lauric acid having 9 ethylene oxides (Alkasurf-L-9). The presence of the ethoxylated fatty acid in the organic vehicle is essential in the formation of the gel, for the in situ reaction in the organic solvent with the sodium hydroxide to form a small amount of a soap which thickens and gels the organic liquid media. A small amount of sodium hydroxide evokes time-delayed hydroysis followed by gelation of the vehicle holding the ethoxylated fatty acid.

Another essential component of present cleaning composition is the water miscible organic solvent in an amount of about 15–35% by weight of the total formulation. The organic solvent provides an organic media for the in situ reaction between the ethoxylated fatty acid and the sodium hydroxide in the gelling of the organic media. Suitable organic water miscible solvents include the lower alkyl monohydric alcohol, lower alkyl dihydric alcohols (glycols), the lower alkyl glycol ethers, and mixtures thereof. Examples of water soluble lower monohydric alcohols are ethanol, iso-propanol, and butanol. Examples of suitable glycols are ethylene glycol, diethylene glycol (Carbitol), and propylene glycol. Examples of lower alkyl glycol ethers are the diethylene glycol monobutyl ether having the formula: $C_4H_9OCH_2CH_2OCH_2CH_2OH$ also known as Butyl Carbitol (Union Carbide) glycol monobutyl ether having the formula: $C_4H_9OCH_2CH_2OH$ and the like. It is preferred to use a mixture of monohydric and dihydric alochol and most preferably a mixture of a monohydric alcohol, and dihydric alcohol and a glycol ether as the solvent for the nonionic surfactant mixture.

Another essential ingredient in present viscous cleaning composition is a water-soluble inorganic particulate abrasive, suspended in the gelled vehicle, in an amount of about 10–25% by weight of the total composition. The abrasive is insoluble in the gel, but soluble in water. The water soluble abrasive particles are relatively large particles of about ½ mm in diameter. The viscosity of the gelled vehicle which is a minimum of 14,000 to 15,000 cps units, is capable of maintaining the large particles in suspension. Suitable water soluble abrasives are selected from the group consisting of alkali metal phosphates, polyphosphates and carbonates. Examples of suitable water soluble abrasives include pyrophosphates such as tetrasodium or tetrapotassium pyrophosphates, tripolyphosphates, tetrapolyphosphates, carbonates, etc. This abrasive becomes a surfactant-builder when the product is used diluted and is readily removed from the cleaned surface, leaving no gritty residue. The preferred abrasives include tetrasodium pyrophosphate, and sodium carbonate.

The hard surface cleaning composition of this invention also may contain minor amounts of conventional additional components to impart any desired characteristic, which are compatible with the gel and do not adversely affect the gel structure. Suitable additives include coloring agents, perfumes, preservatives, antiseptic agents and the like. These additives constitute a maximum of 15% by weight of the composition.

The cleaning compositions of present invention are generally prepared by mixing the organic water miscible solvent components with an ethoxylated fatty acid and at least one additional nonionic surfactant component to form a clear, low viscosity liquid vehicle; adding a sodium hydroxide solution to the clear liquid vehicle and mixing until the liquid gels, which may vary from a few minutes to several hours, depending on the amounts of the components; and lastly admixing the water soluble abrasive, color, perfume and any other additional conventional ingredient with the gelled vehicle, until the abrasive is uniformly dispersed throughout the gelled vehicle and a paste is formed. The cleaning composition is packaged in any suitable container, both flexible or rigid. The paste can also be extruded from a collapsible container.

The final cleaning gel product is a stable thick (viscous) creamy, hard surface cleaner, substantially free of water, and has an alkaline pH within the range of about 8–11. It can be applied to the surface to be cleaned in any suitable manner, i.e., with a sponge or a cloth, followed by rinsing the surface with water, leaving no gritty residue.

The following examples merely illustrate the invention, but it is understood that the invention is not limited thereto. All amounts of various ingredients in the examples and elsewhere in the specification are by weight unless otherwise specified.

EXAMPLE 1

| Ingredients | % |
|---|---|
| Lauric Acid Ethoxylate (9EO) | 28.30 |
| Tetrasodium Pyrophosphate | 20.00 |
| Diethylene Glycol Monobutyl Ether | 14.00 |
| Ethanol | 14.00 |
| $C_{10}$–$C_{14}$ Alcohol EO 5:1 | 10.00 |
| Propylene Glycol | 6.00 |
| Deionized Water | 4.00 |
| Caustic Soda (50%) | 3.00 |
| 1% Graphtol Blue | 0.40 |
| Perfume | 0.30 |
| pH (1%) = 10.9 | |

The vehicle ingredients, namely ethoxylated lauric acid, ethoxylated alcohol, butyl carbitol, ethanol and propylene glycol and the perfume are mixed to form a clear mobile liquid. The NaOH is mixed with the clear liquid until the vehicle is gelled and forms a solid gel. After 5 minutes of gel ripening the tetrasodium-pyrophosphate is mixed with the ripened gel to form a cream (paste). The blue pigment dispersion is admixed with the cream.

This formulation produces a creamy blue cleaning product possessing superior cleaning properties, leaving no gritty residue on the cleaned surface.

EXAMPLE 2

| Ingredients | % |
|---|---|
| Lauric Acid Ethoxylate (9EO) | 28.00 |
| Sodium Carbonate | 23.00 |
| $C_{10}$–$C_{14}$ Alcohol EO 5:1 | 21.00 |
| Ethanol | 12.50 |
| Diethylene Glycol Monobutyl Ether | 7.00 |
| Propylene Glycol | 5.00 |
| 38% Caustic Soda | 3.00 |
| Perfume | 0.30 |
| Lemon/Lime Color Solution | 0.20 |

This product is prepared in accordance with the process of Example 1.

This product is a viscous colored paste also having superior cleaning properties.

EXAMPLES 3–5

| | 3 | 4 | 5 |
|---|---|---|---|
| Alfonic 1012-60[1] | 48.0 | 10.0 | 14.0 |
| Alkasurf L-9[2] | 6.0 | 28.3 | 21.0 |
| Plurafac RA40[3] | — | — | 7.0 |
| Pluronic L-64[4] | 15.5 | — | — |
| Butyl Carbitol | 8.0 | 14.0 | 7.0 |
| Propylene Glycol | — | 6.0 | 6.0 |
| Ethanol | 8.0 | 14.0 | 14.0 |
| Water & Color | .9 | 5.9 | 5.9 |
| NaOH | .7 | 1.5 | 1.5 |
| Tetrasodium pyrophosphate | 12.0 | 20.0 | 23.0 |
| Fragrance | .5 | .3 | .3 |

[1]$C_{10}$–$C_{14}$ alcohol EO 5:1
[2]Lauric acid EO 9:1
[3]Low forming polyol: propylene oxide and ethylene oxide poly-condensates of propylene glycol
[4]High foaming polyol: propylene oxide and ethylene oxide poly-condensates of propylene glycol These compositions are prepared in accordance with the process of Example 1.

The final products are viscous hard surface cleaning compositions, easily removed by rinsing with water without having a gritty residue.

All of the above undiluted cleaning pastes can be diluted with water for equally effective cleaning of hard surfaces. The entire paste product dissolves in water leaving no gritty residue, i.e., abrasive particles, on or around the cleaned surfaces.

It is understood that the foregoing detailed description is given merely by way of illustration and that variations may be made therein without departing from the spirit of the invention.

I claim:

1. A hard surface high viscosity organic cleaning composition comprising by weight, about 65–80% of an organic liquid vehicle consisting essentially of about 15–35% of a water miscible organic solvent, about 3570% of a nonionic surfactant mixture containing an ethoxylated fatty acid as one of the surfactants, wherein the ethoxylated fatty acid constitutes about 6–38% by weight of the composition, and about 0.7–1.5% sodium hydroxide, gelled by the in situ reaction of the ethoxylated fatty acid with the sodium hydroxide to form a clear, nonflowable gelled vehicle, substantially free of water; and about 10–25% by weight of an inorganic water soluble particulate abrasive incorporated into the gelled vehicle.

2. The composition according to claim 1, wherein the water miscible organic solvent is selected from the group consisting of a lower alkyl glycol ether, lower alkyl monohydric alcohol, lower alkyl dihydric alcohol and mixtures thereof.

3. The composition according to claim 2, wherein the water miscible organic solvent is a mixture of a monohydric alcohol, a dihydric alcohol and a glycol ether.

4. The composition according to claim 3, wherein the water miscible organic solvent is a mixture of ethanol, propylene glycol and diethylene glycol monobutyl ether.

5. The composition according to claim 2, wherein the water miscible organic solvent is a mixture of ethanol and diethylene glycol monobutyl ether.

6. The composition according to claim 1, wherein the cleaning pastes have a minimum viscosity of about 14,000 to 15,000 cps units, measured on Brookfield HATD viscometer.

7. The composition according to claim 1, wherein the nonionic surfactant in the mixture with the ethoxylated fatty acid is selected from the group consisting of a polyethylene oxide condensate of a $C_6$–$C_{22}$ alkyl phenol, a polyethylene oxide condensate of an aliphatic $C_8$–$C_{22}$ alcohol, a polyethylene oxide condensate of the condensation product of propylene oxide with propylene glycol having a molecular weight of about 1500 to 1800, and mixtures thereof.

8. The composition according to claim 7, wherein the nonionic surfactant is polyethylene oxide (5EO) $C_{10}$–$C_{14}$ alcohol.

9. The composition according to claim 1, wherein the ethoxylated fatty acid is lauric acid having 9 ethylene oxides per mole lauric acid.

10. The composition according to claim 1, wherein the water soluble particulate abrasive is selected from the group consisting of alkali metal phosphates, polyphosphates, and carbonates.

11. The composition according to claim 10, wherein the water soluble abrasive is tetrasodium pyrophosphate.

12. The composition according to claim 11, wherein the water miscible organic solvent is a mixture of ethanol, propylene glycol and diethylene glycol monobutyl ether, and the nonionic surfactant mixture is an ethoxylated fatty acid and an ethoxylated fatty alcohol.

13. The composition according to claim 10, wherein the water soluble abrasive is sodium carbonate.

14. The composition according to claim 13, wherein the water miscible organic solvent is a mixture of ethanol, propylene glycol and diethylene glycol monobutyl ether, and the nonionic surfactant mixture is $C_{10}$–$C_{14}$ alcohol EO 5:1 and ethoxylated 9EO lauric acid.

* * * * *

UNITED STATES PATENT AND TRADEMARK OFFICE

CERTIFICATE OF CORRECTION

PATENT NO. : 4,784,788

DATED : November 15, 1988

INVENTOR(S) : Albert J. Lancz

It is certified that error appears in the above—identified patent and that said Letters Patent is hereby corrected as shown below:

In Claim 1, line 56, "3570%" should read ---35-70%---.

Signed and Sealed this

Twenty-first Day of November, 1989

*Attest:*

JEFFREY M. SAMUELS

*Attesting Officer*

*Acting Commissioner of Patents and Trademarks*